United States Patent [19]

Waxman et al.

[11] 4,066,456

[45] Jan. 3, 1978

[54] INCORPORATED CARBOXY SUBSTITUTED P-PHENYLENEDIAMINE COLOR DEVELOPER

[75] Inventors: Burton H. Waxman, Endwell; Michael C. Mourning; Theodore Panasik, both of Vestal, all of N.Y.

[73] Assignee: GAF Corporation, New York, N.Y.

[21] Appl. No.: 531,399

[22] Filed: Dec. 10, 1974

[51] Int. Cl.[2] ..... G03C 5/54; G03C 7/00; G03C 1/40; G03C 5/30

[52] U.S. Cl. ..... 96/29 D; 96/3; 96/55; 96/56.2; 96/56.3; 96/56.4; 96/56.5; 96/66 R; 96/66 HD; 96/74; 96/77; 96/95; 96/100 R

[58] Field of Search ..... 96/3, 29 D, 77, 66 R, 96/66.3, 55, 56.6, 74, 95, 97, 100, 66 HD, 56.2–56.5

[56] References Cited

U.S. PATENT DOCUMENTS

| | | | |
|---|---|---|---|
| 2,066,918 | 1/1937 | von Poser et al. | 96/54 |
| 2,163,166 | 6/1939 | Wilmanns et al. | 96/66 R |
| 2,196,739 | 4/1940 | Peterson | 96/66 R |
| 2,322,027 | 6/1943 | Jelley et al. | 96/97 |
| 2,522,802 | 9/1950 | Sargent et al. | 96/56.6 |
| 2,603,659 | 7/1952 | Raasch | 96/66 R |
| 2,728,669 | 12/1955 | Tulagin | 96/56.6 |
| 2,774,668 | 12/1956 | Rogers | 96/3 |
| 2,949,360 | 8/1960 | Julian | 96/97 |
| 3,271,152 | 9/1966 | Hanson | 96/97 |
| 3,359,104 | 12/1967 | Viro | 96/3 |
| 3,535,113 | 10/1970 | Hove et al. | 96/56.5 |
| 3,676,124 | 7/1972 | Ohkubo et al. | 96/3 |
| 3,705,035 | 12/1972 | Vetter et al. | 96/3 |
| 3,728,116 | 2/1973 | Waxman et al. | 96/3 |
| 3,779,756 | 12/1973 | Farran et al. | 96/3 |

FOREIGN PATENT DOCUMENTS

| | | | |
|---|---|---|---|
| 1,080,576 | 8/1967 | United Kingdom | 96/3 |

*Primary Examiner*—David Klein
*Assistant Examiner*—Richard L. Schilling
*Attorney, Agent, or Firm*—Walter C. Kehm; Edward G. Comrie

[57] ABSTRACT

A derivative of paraphenylenediamine, for use as a color developer, having a primary amino group available for oxidative coupling, and a carboxy group bound to the benzene ring to provide the compound with the required stability to enable the compound to be incorporated into a photographic film, the compound being non-diffusible during development of the photographic film in an alkaline processing solution.

19 Claims, 2 Drawing Figures

INCORPORATED CARBOXY SUBSTITUTED P-PHENYLENEDIAMINE COLOR DEVELOPER

Figure 1:
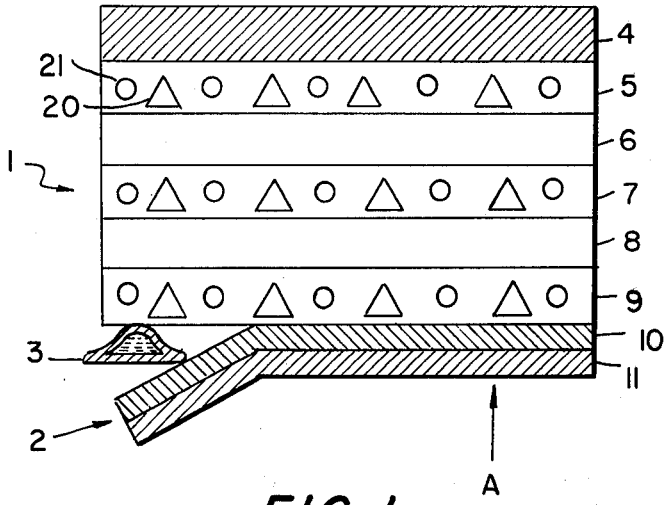

The present invention relates to new paraphenylenediamine derivatives which are useful as photographic developers, and more particularly as developers that are incorporated into a photographic silver halide emulsion layer or in an adjacent layer.

Paraphenylenediamine and its derivatives are used in photography, particularly as color developers, but these developers have been used commercially only in an alkaline processing solution applied to the film package externally of the package.

Efforts have been made to incorporate the paraphenylenediamine developer within the photographic element itself, but these attempts have not been successful primarily due to the lack of stability of the paraphenylenediamine to aerial oxidation and other forms of environmental degradation. In addition, the incorporated paraphenylenediamine developer tends to fog a silver halide emulsion. Despite the need for a paraphenylenediamine developer that can be incorporated into a photographic element, there has nevertheless been no commercial product marketed employing an incorporated paraphenylenediamine developer.

It is an object of the present invention to provide a derivative of paraphenylenediamine that may be incorporated into a photographic element.

It is another object of the present invention to provide such a paraphenylenediamine derivative that has the required stability to resist environmental degradation without sacrificing reactivity of the derivative as a photographic developer.

It is another object of the invention to provide a paraphenylenediamine derivative that may be used as a photographic developer and may be incorporated into a photographic element without danger of fogging the silver halide emulsion.

These and other objects of the invention are provided by the present invention, which resides in a derivative of paraphenylenediamine having a primary amino group available for oxidative coupling, and a carboxy group bound to the benzene ring to provide the developer with the required stability to enable the developer to be incorporated into the film, the compound being non-diffusible during development in an alkaline processing solution.

The present invention also provides a photographic element comprising a support, a silver halide photographic emulsion carried by said support and the developer of the present invention incorporated into said emulsion or in a layer adjacent thereto.

We are aware of U.K. Pat. No. 1,080,576, which proposes the use of 4(N-pyrrolidino)aniline 3-carboxylic acid as an intermediate in the production of diazonium compounds useful in diazotype materials. We are also aware of the proposal in Japanese Derwent Abstract J7 4026893, volume 74, No. 38, of the use of carboxy-containing diazonium compounds for use in diazotype materials developed by heating. There is also a series of U.S. Patents covering 4,6-diaminoaniline containing a sulfoxy or carboxy group on the phenyl ring as storage stable azine developers, viz. U.S. Pats. Nos. 2,486,440; 2,570,116; 2,727,062; and 2,728,669. So far as we are aware, there has never been any proposal for the use of the compounds of formula (I) below as a photographic developer incorporated into, or in a layer adjacent to, a photographic silver halide emulsion.

The compounds of the present invention, which are useful as incorporated photographic developers, are represented by the general formula:

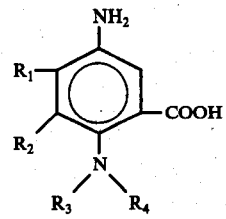

(I)

where $R_1$ is hydrogen, halogen, an aliphatic group or an aromatic group;

$R_2$ is hydrogen; and $R_3$ and $R_4$ are independently hydrogen, an aliphatic group or an aromatic group; or $R_2$ and $R_3$ together represent the necessary ring members to form a heterocyclic ring with the nitrogen atom to which $R_3$ is attached being the sole heteroatom or there being a second heteroatom selected from nitrogen, oxygen and sulfur; or $R_3$ and $R_4$ together represent the necessary ring members to form a heterocyclic ring with the nitrogen atom to which they are attached being the sole heteroatom or there being a second heteroatom selected from nitrogen, oxygen and sulfur; provided that at least one of $R_1$, $R_2$, $R_3$ and $R_4$ by itself, or the net effect of $R_1$, $R_2$, $R_3$ and $R_4$ is of such molecular size and configuration as to render the compound oil-soluble and essentially non-diffusible during development in an alkaline processing composition.

In particular, useful compounds of the invention of formula (I) are those in which $R_1$ is hydrogen, halogen, an aliphatic group or an aromatic group;

$R_2$ is hydrogen; or $R_2$ and $R_3$ together with the nitrogen atom to which $R_3$ is attached form a 5- to 7-membered heterocyclic ring with said nitrogen atom being the sole heteroatom; or $R_3$ and $R_4$ are hydrogen, an aliphatic group or an aromatic group; or $R_3$ and $R_4$ together with the nitrogen atom to which they are attached form a 5- to 7-membered heterocyclic ring with said nitrogen atom being the sole heteroatom or there being a second heteroatom selected from nitrogen, oxygen and sulfur; provided that at least one of $R_1$, $R_3$ and $R_4$, or the net effect of $R_1$, $R_3$, and $R_4$ is of such molecular size and configuration to render the compound oil-soluble and essentially non-diffusible during development in an alkaline processing solution. In these embodiments, when $R_1$ is aromatic, it is preferably phenyl or phenoxy, and when $R_3$ is aromatic, it is preferably phenyl.

In a preferred embodiment of the invention, $R_1$ is hydrogen, straight or branched chain alkyl or alkoxy of 1 to 18 carbon atoms, most preferably straight or branched chain lower alkyl or alkoxy;

$R_2$ is hydrogen;

$R_3$ is straight or branched chain alkyl of 1 to 18 carbon atoms, most preferably straight or branched chain lower alkyl, unsubstituted or substituted by lower alkoxy, sulfonamido, alkylsulfonamido, carbamyl, hydroxy or amino; or $R_2$ and $R_3$ together with the nitrogen atom to which $R_3$ is attached form an unsubstituted, saturated 5- to 7-membered heterocyclic ring with said nitrogen atom being the sole heteroatom;

$R_4$ is a photographically inert, organic ballasting group of such molecular size and configuration to render the compound oil-soluble and essentially non-diffusible during development in an alkaline processing solution; or $R_3$ and $R_4$ together with the nitrogen atom to which they are attached from a heterocycle selected from the group consisting of pyrrolidino, piperidino or hexahydroazepino, said heterocycle being unsubstituted or being substituted on one of said carbon atoms by alkyl of 1 to 18 carbon atoms, provided that said substituted heterocycle, or the net effect of $R_1$ and said unsubstituted or substituted heterocycle, is of such molecular size and configuration to render the compound oil-soluble and essentially non-diffusible during development in an alkaline processing solution.

The terms lower alkyl and lower alkoxy denote a chain of from 1 to 6 carbon atoms.

In general, the presence of the carboxylic acid group on the benzene ring imparts sufficient stability to the paraphenylenediamine to enable it to be incorporated into a photographic element. Paraphenylenediamine color developers are well known, and an extensive list of prior art paraphenylenediamines is presented in J.A.C.S., 73, pages 3100–3125 (1951) in the article by Bent et al. This article shows the variety of aliphatic groups that may be present on the ring or on a nitrogen atom of the paraphenylenediamine molecule, and such aliphatic groups may also be present in the compounds of the invention. Accordingly, it is to be understood that the term aliphatic group is exemplified by, but not limited to, alkyl, alkoxy, alkylamido, or alkyl substituted by lower alkoxy, sulfonamido, alkylsulfonamido, carbamyl, hydroxy or amino. As examples of saturated or unsaturated heterocyclic rings containing nitrogen as the sole heteroatom or containing sulfur, oxygen or nitrogen as the second heteroatom, which are formed when $R_2$ and $R_3$ or $R_3$ and $R_4$ are joined together, there may be mentioned pyrrolidino, piperidino, piperazino, morpholino, hexahydroazepino, dihydroindol and tetrahydroquinoline.

Useful compounds of formula (I) include:

a.

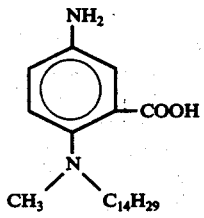

-continued b.

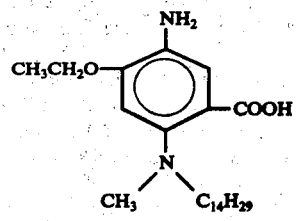

c.

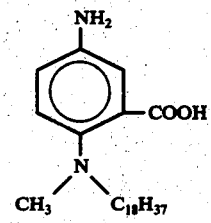

d.

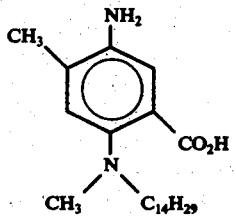

e.

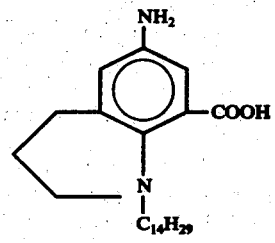

f.

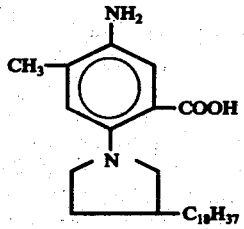

g.

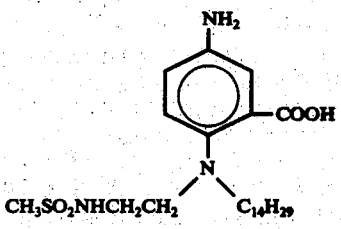

h.

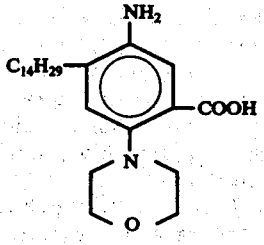

-continued i.

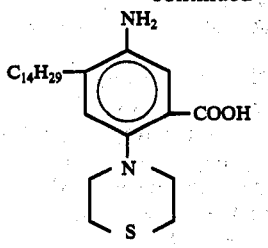

j.

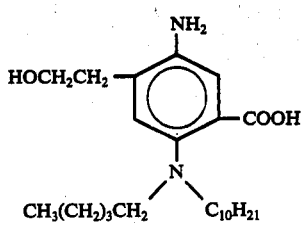

k.

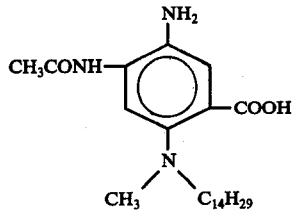

l.

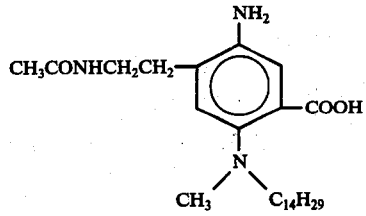

m.

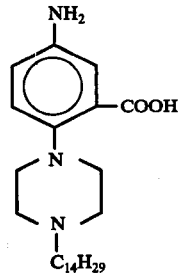

n.

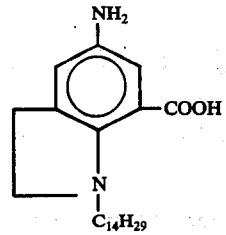

o.

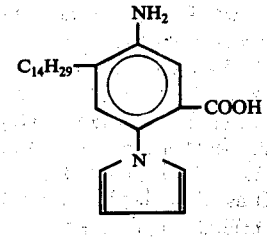

-continued p.

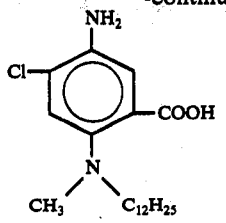

q.

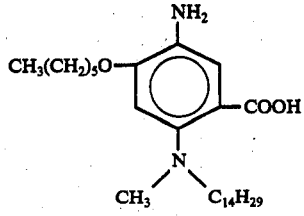

r.

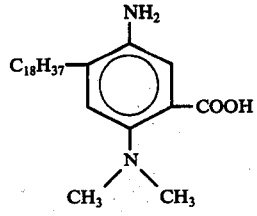

s.

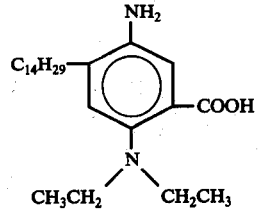

The compounds of the invention may be prepared by the following synthesis A, wherein a 2-halo-5-nitro-benzoic acid (II) is reacted with the appropriate amine (III) in a solvent as shown below:

A.

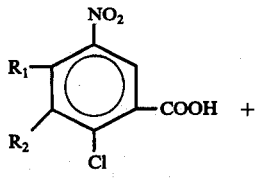

(II)

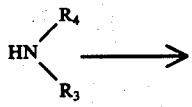

(III)

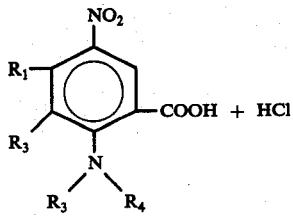

(IV)

and then reducing the nitro group of the intermediate (IV) using hydrogen and a catalyst, such as platinum, palladium or Raney nickel, or chemical reduction to form the final product (I). In the above description, $R_1$, $R_2$, $R_3$ and $R_4$ are as defined above, except that $R_2$ and $R_3$ are not joined together.

Alternatively, the procedure of Weissberger et al, J. Am. Chem. Soc., page 68, (1935) may be used to form

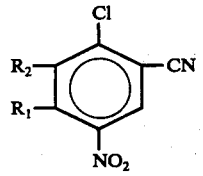

(V)

wherein $R_1$ and $R_2$ are as defined above, and compound (V) is then used in synthesis B below:

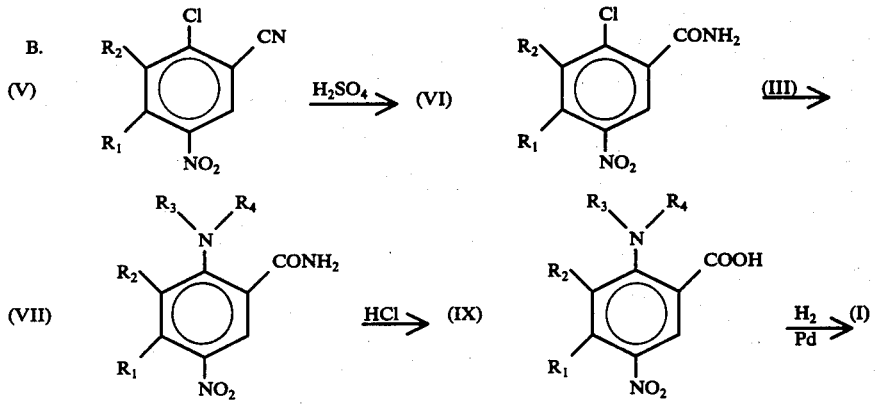

In the above description, $R_1$, $R_2$, $R_3$ and $R_4$ are described above, except that $R_2$ and $R_3$ are not joined together.

The following synthesis C may be used for structures where $R_2$ and $R_3$ form a heterocyclic ring fused to the benzene ring:

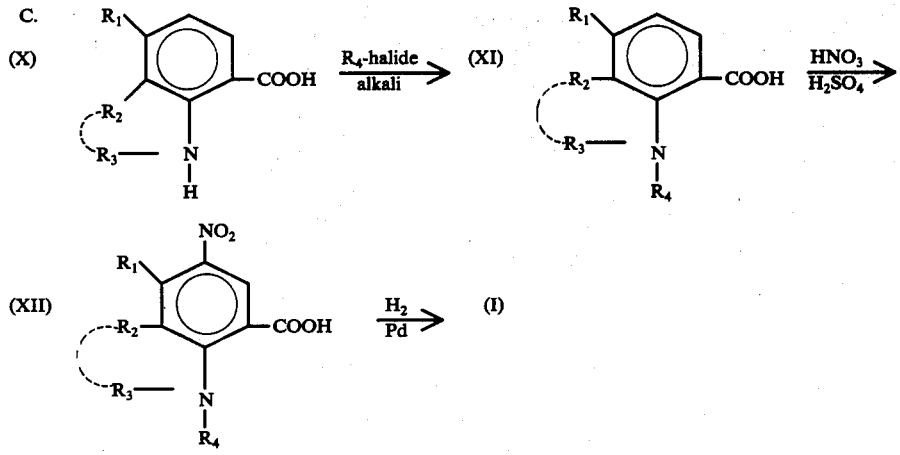

The reaction of compound III with $R_4$-halide follows the teaching of O. Fischer and R. Endres, Berichte, 35, page 2611, 1902.

The reactants used in the syntheses A, B and C, namely compounds (II), (III), (V) and (X), and the halide $R_4$-halide, are all known compounds and/or are synthesized by known techniques. Hence the preparation of the final compound (I) may be effected without difficulty.

The compounds of the present invention are lipophilic, non-diffusible, paraphenylenediamine photographic developers having resistance to aerial oxidation. These developers can be incorporated directly into a photographic silver halide emulsion without fogging the emulsion. Surprisingly, the enhanced stability characteristic of the new developers is not accompanied by a loss of reactivity.

The developers of the invention may be used to advantage in any photographic process in which a photographic developer is used to develop an exposed photographic silver halide emulsion, and particularly those processes forming a non-diffusible coupled product as a function of development by reaction between the oxidized developer and a reactant.

In all of these processes, the developer, in the form of an oil dispersion, is incorporated into the silver halide layer or a layer adjacent thereto, rather than in the processing solution. As is conventional, the developer is used in an amount to ensure complete development of its associated silver halide layer, i.e. in excess of the stoichiometric amount needed to develop all of the silver halide in the associated silver halide layer. The developer is actuated by applying to the film a processing solution containing a small amount of an auxiliary black and white photographic developing agent that exhibits an activating effect with a paraphenylenediamine developer, such as Metol, phenidone B and phenidone A. The phenomenon of black and white developers exhibiting an additive effect with paraphenylenediamine color developers is discussed by Mason in J. Photo. Science, Vol. 11, (1963), page 163. Black and white developers, such as Metol, phenidone A, phenidone B, exhibited this effect, while others, such as hydroquinone, actually deactivated the color developer. We employ as the auxiliary developing agent any black and white developer that acts with the developer of the invention to produce the color image. The auxiliary developing agent is used because the developer of the present invention is lipophilic and has little solubility in water or alkali, and hence there would be only an insufficient amount of the lipophilic developer transferred to the exposed silver halide grains for development at any meaningful speed or density. The auxiliary developing agent reduces the exposed silver halide grains, and the oxidation product of the oxidized auxiliary developing agent then diffuses into the oily material containing the lipophilic developer of the invention, where it is reduced by the developer of the invention to re-form the auxiliary developing agent, which then can reduce additional exposed silver halide. Since the oxidized auxiliary developing agent is continuously being renewed, only a small amount is required, such as from 0.1 to 10 grams, preferably 0.5 to 1.5 grams, per liter of processing solution. Additionally, the speed of the auxiliary developing agent acting with the lipophilic developer, as described above, is quite fast.

The processing solution is used at a pH of 10.0 to 14.0, preferably 10.0 to 13.0, and the auxiliary development agent is most conveniently contained in the processing solution itself. The processing solution may also contain the usual developer additives, such as preservatives, e.g. $Na_2SO_3$, restrainers, e.g. KBr, and the like.

The processing solution can be part of the film package, as e.g. in a pod in the film package, or can be entirely external of the film package. Since the processing solution contains no paraphenylenediamine derivative, the problems caused by its allergenic properties are eliminated. By means of the developer of the invention, it is possible to obtain the advantages of a paraphenylenediamine developer without many of its disadvantages.

Broadly speaking, the developer of the invention may be incorporated into a photographic silver halide emulsion, or into a layer adjacent thereto, to provide a photographic element useful in black and white or color photography, both in diffusion transfer as well as conventional photographic processes. For the simplest case, a black and white negative can be formed by incorporating the developer of the invention in or adjacent to a panchromatic silver halide emulsion, and developing the exposed emulsion by treatment with the alkaline processing solution described above. Alternatively a black and white positive can be formed by using a direct positive emulsion.

The developer of the invention can also be used in black and white or color silver stream diffusion transfer processes. In such cases, the developer of the invention is incorporated into, or in a layer adjacent to, each silver halide emulsion layer, and the exposed silver halide is developed by treatment with the alkaline processing solution and the unexposed silver halide is partially solubilized to form silver ions that are drawn into an adjacent layer where the silver ions serve as image-wise oxidants to release substractive color formers or dyes that migrate to a receiving sheet, or the silver ions migrate to a receiving sheet where they are reduced to form a black and white positive image.

In the above cases, the oil droplet most preferably contains a lipophilic material that will react with oxidized developer of the invention to prevent a build-up of oxidized developer in the system. A suitable material is a lipophilic white coupler, i.e. a coupler that forms a colorless coupled product. In these cases, the lipophilic reactive material is passive and is present merely as a scavenger for oxidized developer of the invention.

In other cases, the developer of the invention and a lipophilic reactant reactive with oxidized developer are incorporated into an oil dispersion in, or in a layer adjacent to, the silver halide emulsion layer so that the reactant is available for reaction with oxidized developer as soon as the oxidized developer is formed for a particular purpose other than merely to get rid of oxidized developer. In black and white photography, the reactant may be a non-diffusible coupler used to form a non-diffusible coupled product that adds to the density of a developed X-ray film. In conventional color photography, the reactant is a lipophilic incorporated coupler, and the development of such a photographic element with the alkaline processing solution avoids the use of a paraphenylenediamine in the processing solution. Such color photographic elements may be either color negative or reversal photographic materials, and the lipophilic non-diffusing color couplers may be any of those known in the art as such.

The developer of the invention is especially useful in direct positive, multi-color diffusion transfer photography in which a lipophilic diffusible coupler is incorporated into the oily phase with the developer. A wide variety of lipophilic couplers may be used with the developer of the invention to provide improved diffusion transfer photographic elements. Thus, suitable couplers are those that are a. soluble in high boiling, photographically inert oils;
b. essentially non-diffusible through an aqueous gelatin matrix at pH ranges normally employed in coating operations;
c. soluble and readily diffusible through the photographic element at development pH, e.g. in the range of 10 to 14; and
d. reactive with oxidized developer to form a coupled product that is non-diffusible at the development pH.

The coupler will either be a colored coupler of a desired hue, or may be a colorless coupler that will react with an oxidized color developer to form a dye of desired hue. In both cases, the coupler will couple with oxidized developer of the invention in image-wise exposed areas of the photographic element to form a non-diffusible coupled product, the color of which being irrelevant since it plays no part in the image-forming process. In unexposed areas, the coupler is free to diffuse to a receiving element or receiving sheet. If a colored coupler of desired hue is employed, the transferred positive dye image is immobilized in a suitable mordant, such as gelatin, polyvinylpyridine, quaternary ammonium salts, or the like. Suitable mordants for colored couplers are described, e.g. in U.S. Pat. No. 2,774,668 and other prior art literature. If a colorless coupler is employed, the coupler transferred to the receiving sheet or layer is converted to a non-diffusible dye by reaction with oxidized color developer in a suitable mordant, as is conventional, for example by applying to the receiving sheet or layer a separate alkaline processing solution containing a color developer so as to form the desired dye by coupling, there being an oxidizing agent in the receiving sheet or layer, or in a separately applied solution. If necessary or desired, delayed diffusion of color-providing species by means of timing layers or changes in pH, or the like, may also be used. See, e.g. U.S. Pat.

Nos. 3,301,772 and 3,359,104. See also U.S. Pat. No. 2,774,668.

Lipophilic colored couplers that meet the criteria set forth above are known in the art, such as the water-insoluble couplers disclosed in Rogers U.S. Pat. No. 2,774,668, which is hereby incorporated herein by reference thereto, or can readily be devised by modification of known colored couplers by known techniques.

Colored couplers that have use in the present invention can be prepared by attaching a coupler moiety to a dye through a linking group. For example, a dye containing a $-SO_3Na$ group or modified to include such group is readily converted to the acid chloride form, Dye-$SO_2Cl$, by using known techniques as in U.S. Pat. Nos. 2,888,486; 2,759,921; 2,219,330; and 2,560,881. These patents also describe forming a sulfonamide, Dye-$SO_2$—NH—R, and that procedure is employed herein to attach to the dye a suitable coupler moiety, i.e. where R is

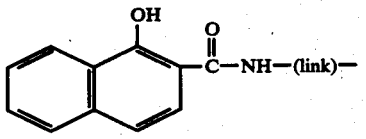

and link is a direct bond or a linking group, such as phenylene or alkylene.

We prefer to form the acid chloride of the dye using dimethylformamide and dioxane as solvent and reacting Dye-$SO_3Na$ with $SOCl_2$ in this solvent at room temperature for 2–24 hours. The acid chloride is precipitated out of the reaction mass by pouring into water and is then worked up. The acid chloride is then reacted with a coupler-link-$NH_2$, such as

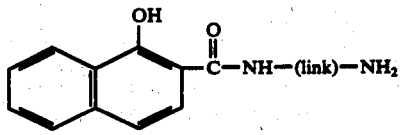

in pyridine or other suitable solvent at a temperature of from −5° C to room temperature for 5–24 hours to form the final product.

The intermediate, coupler-link-$NH_2$, is prepared by conventional techniques. Thus,

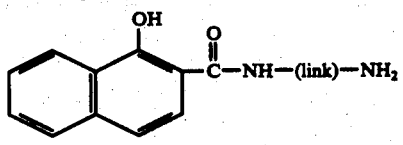

is readily obtained by reacting phenyl-1-hydroxy-2-naphthoate with m-nitroaniline in the melt for 4 hours at 160° C, in an esteramide interchange reaction. The product, which crystallizes out is worked up and the nitro group reduced, as by hydrogen and a palladium catalyst. The final product is a colored coupler where link is phenylene. Alternatively, the naphthoate can be reacted with 1,6-hexamethylenediamine in refluxing benzene for several hours to form an intermediate for a colored coupler, where link is hexamethylene.

Colored couplers A through H below are prepared using the above techniques:

Colored Couplers A-H

A.

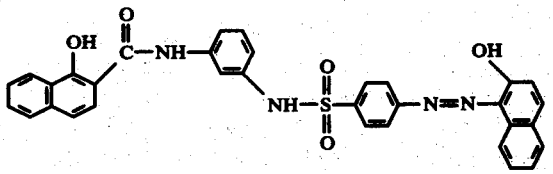

(orange)

B.

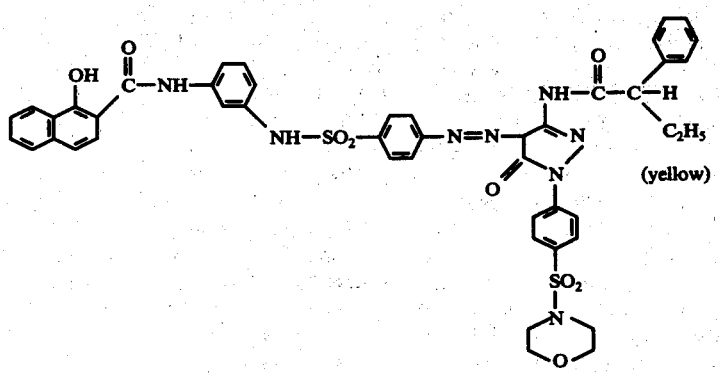

(yellow)

-continued

Colored Couplers A-H

C.

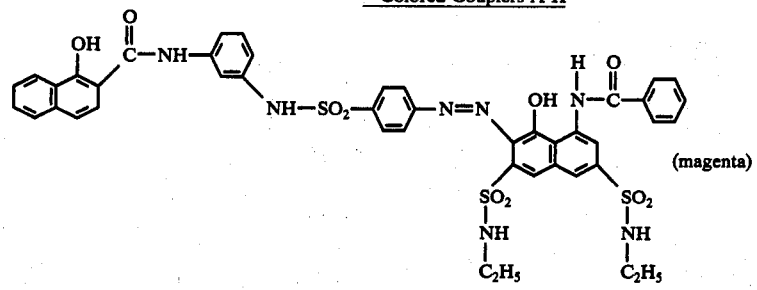

(magenta)

D.

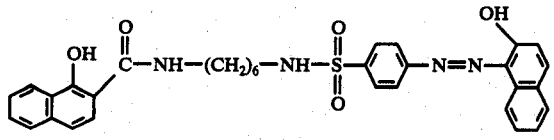

(orange)

E.

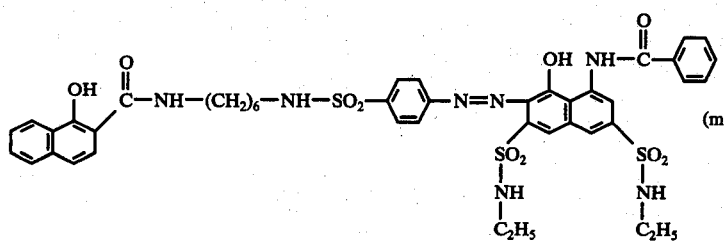

(magenta)

F.

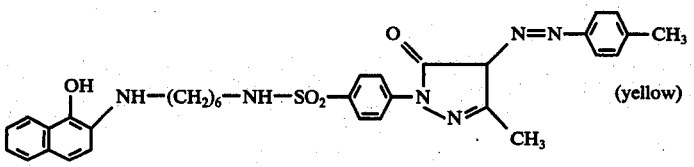

(yellow)

G.

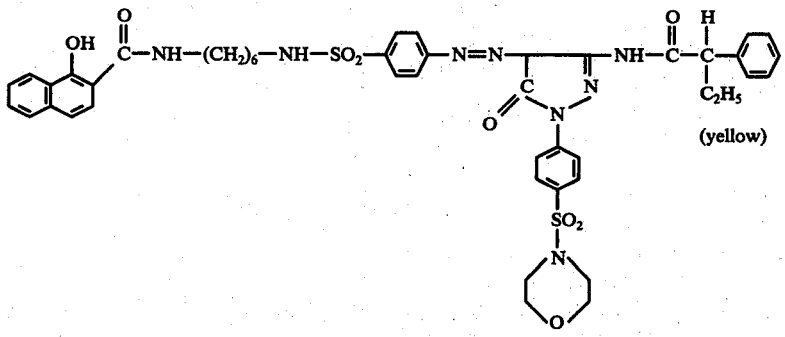

(yellow)

H.

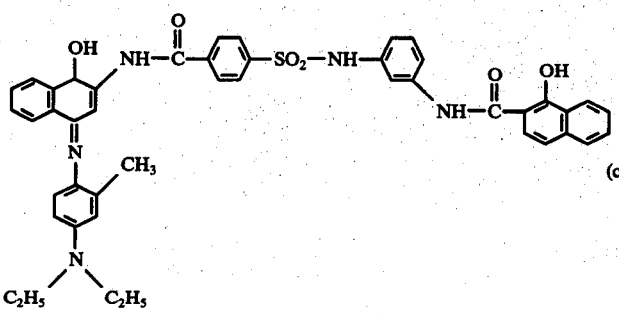

(cyan)

Many of the conventional low molecular weight colorless couplers known to the art as "non-incorporated couplers", and normally present in developer solutions but never present in photosensitive elements, become soluble and diffusible through the photographic material at a pH of about 10–11 and meet all of the other criteria described above, and hence are useful in this invention. Among these may be mentioned Eastman Kodak color formers C-10, M-38 and Y-54, which are, respectively, N-(α-acetamido phenethyl) 1-hydroxy-2-naphthamide (cyan color former, 1-(2,4,6-trichlorophenyl)-3-p-nitroanilino-2-pyrazolin-5-one (magenta color former), and α-benzoyl-O-methoxy acetanilide (yellow color former).

The colorless couplers disclosed in Viro U.S. Pat. Nos. 3,301,772, 3,359,104 and 3,728,116, which are incorporated herein by reference thereto, may also be used to advantage. These color formers are of medium molecular weight, become diffusible at a pH of about 12.5 to 13.0, and also meet the other criteria set forth above.

The use of the incorporated developer of the invention provides the possibility of a true, one-step, cross-talk-free, direct positive, multi-color diffusion transfer process, since the lipophilic developer/auxiliary developing agent combine to develop the exposed silver halide at great speed and the lipophilic developer is confined to the oily material. Hence, not only is there rapid development, but the diffusing coupler, once it leaves the oily phase associated with one silver halide layer, does not come into contact with lipophilic developer in or adjacent to any other silver halide layer, and hence there is no dye drop-off. Thus, the oily material acts to ensure that the oxidized lipophilic developer couples only with coupler in its own oily material. In addition, the developer of the inventor also offers the advantage of a simplified coating operation, since the developer, coupler and silver halide emulsion can be coated as a single layer in one step.

Other benefits flow from having the developer of the invention incorporated into the film itself, rather than in the processing solution. Thus, there is no decomposition of the developer due to storage thereof in the highly alkaline processing solution. Further, a developer of high reactivity can be used, whereas prior art incorporated developers have sacrificed reactivity for stability in the film. In addition, a uniform distribution of developer can be insured by control over the coating operation. These advantages are possible due to the unique combination of reactivity, resistance to environmental degradation and lack of fogging inherent in the new developer.

Since the new developer is lipophilic, it is incorporated into the film package by dispersing or dissolving the developer into a high boiling, photographically inert oily material, such as high boiling esters, alcohols, oils or mixtures thereof, dispersing the oil/developer admixture in aqueous gelatin with the use of an emulsifier, if desired, and then coating the gelatin dispersion over or with the silver halide emulsion. Such a layer could then be overcoated with another silver halide layer. Alternatively, the oil/developer dispersion can be coated on a support, which is then overcoated with the silver halide layer, thereby providing flexibility in accommodating any combination of viewing and exposure.

Where lipophilic couplers are used, either colorless or colored couplers, both the developer and the coupler may readily be dispersed or dissolved in the oil along with the developer, and then the oil dispersion is in turn dispersed in aqueous gelatin and coated in a layer. Unexpectedly, the developer acts as an internal surfactant and promotes the formation of finer oil dispersions of enhanced stability.

The following Examples illustrate the invention. All parts and proportions as referred to herein, and in the appended claims, are by weight unless otherwise noted.

EXAMPLE I

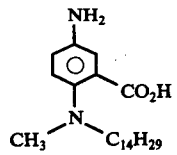

3-carboxy-4-(N-methyl-N-tetradecylamino)aniline a. Preparation of 2-carboxy-4-nitro-N-methyl-N-tetradecylaniline

A mixture of 600g 2-chloro-5-nitrobenzoic acid, 900g methyltetradecylamine (84%, tertiary amines as impurities) and 500 ml triethylamine was heated on a steam bath for 7 hours and then poured into 2 liters of water and made acid with HCl. The reaction product was filtered, air dried and then recrystallized from methanol and then from petroleum ether. Yield: 820g, m.p. = 100°-101°.

| | Analysis | |
|---|---|---|
| | Calc. | Found |
| C | 67.32 | 67.13; 67.36 |
| H | 9.24 | 8.68; 8.80 |
| N | 7.14 | 7.04; 6.93 |

b. Preparation of 3-carboxy-4-(N-methyl-N-tetradecylamino)aniline 820 grams of the product from part (a) above was dissolved in ethanol and reduced using Pd/C and 220 psi $H_2$. After filtering, the ethanol was recovered at reduced pressure and the remaining oil was triturated with petroleum ether. The resulting solid was recrystallized from petroleum ether, methanol and again from petroleum ether. Yield: 600g, m.p. = 79°.

| | Analysis | |
|---|---|---|
| | Calc. | Found |
| C | 72.89 | 73.19; 73.24 |
| H | 10.56 | 10.65; 10.80 |
| N | 7.72 | 7.38; 7.33 |

EXAMPLE II

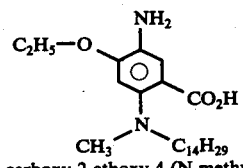

5-carboxy-2-ethoxy-4-(N-methyl-N-tetradecylamino)aniline a. Preparation of 2-carboxy-5-ethoxy-4-nitro-N-methyl-N-tetradecylaniline

A mixture of 24.5g 2-chloro-4-ethoxy-5-nitrobenzoic acid, 22.7g methyl tetradecylamine (distilled) and 35.0 ml triethylamine were heated on a steam bath for 5 hours and then poured into two liters of water and made acid with HCl. The reaction product was filtered and washed with water, and recrystallized twice from methanol/water.

| | Analysis | |
|---|---|---|
| | Calc. | Found |
| C | 66.03 | 66.43; 66.34 |
| H | 9.23 | 9.61; 9.79 |
| N | 6.42 | 6.07; 6.18 |

b. Preparation of
5-carboxy-2-ethoxy-4-(N-methyl-N-tetradecylamino)aniline 15g of the product of part (a) above were dissolved in ethanol and reduced using Pd/C and 50 psi $H_2$. After filtering, the ethanol was removed at reduced pressure and the product was recrystallized twice from petroleum ether. Yield: 13g, m.p. = 80°-81°.

| | Analysis | |
|---|---|---|
| | Calc. | Found |
| C | 70.89 | 70.45; 70.35 |
| H | 10.41 | 10.58; 10.53 |
| N | 6.89 | 6.64; 6.90 |

EXAMPLE III

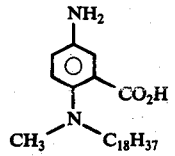

3-carboxy-4-(N-methyl-N-octadecylamino)aniline a. Preparation of
2-carboxy-4-nitro-N-methyl-N-octadecylaniline A mixture of 20g 2-chloro-5-nitrobenzoic acid, 28.6g methyl octadecylamine and 20 ml triethylamine was heated on a steam bath for 6 hours. The resulting solid was dissolved in aqueous ethanol, and then 6N HCl was added to give a pH of 3. The product was filtered and recrystallized from ethanol and then from acetone. m.p. = 108°-109°.

| | Analysis | |
|---|---|---|
| | Calc. | Found |
| C | 69.29 | 69.77; 69.75 |
| H | 10.29 | 9.89; 10.11 |
| N | 6.22 | 6.30; 6.17 |

b. Preparation of
3-carboxy-4-(N-methyl-N-octadecylamino) aniline

Ten grams of the product from part (a) were dissolved in ethanol and reduced using Pd/C — 60 psi $H_2$. The resulting product was then filtered, ethanol was evaporated, and the final product was recrystallized from 90°-110° petroleum ether. Yield 4.5g, m.p. = 81°-83° (corr.).

EXAMPLE IV

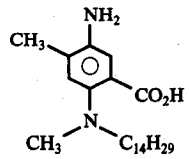

3-carboxy-4-(N-methyl-N-tetradecylamino)-6-methylaniline

This Example illustrates synthesis B.

a. Preparation of 2-chloro-4-methyl-5-nitrobenzamide

A mixture of 25.1 grams 2-chloro-4-methyl-5-nitrobenzonitrile (Weissberger et al, J. Chem, Soc., p.68 (1935) and 200 ml 70% sulfuric acid was heated with stirring on a steam bath for 4½ hours. A precipitate started to form after this time and the mixture was poured into ice water (about 400 ml). The product was filtered, washed with water and recrystallized from ethanol. Yield = 19.2 grams. m.p. = 180°-183° C.

b. Preparation of
2-methyltetradecylamino-4-methyl-5-nitrobenzamide

A mixture of 19.2 grams 2-chloro-4-methyl-5-nitrobenzamide, 21.4 grams methyltetradecylamine and 46.0 ml triethylamine was heated on a steam bath for 20 hours. The mixture was poured into about 200 ml ice water and made acid with concentrated HCl to a pH of 2-3. The mixture was filtered, washed with water and vacuum dried. The crude material was recrystallized from ethanol to give 30 grams product. m.p. = 117°-119°.

| | Analysis | |
|---|---|---|
| | Calc. | Found |
| C | 68.20 | 68.54; 68.85 |
| H | 9.65 | 10.06; 10.02 |
| N | 10.35 | 10.11; 10.11 |

c. Preparation of
2-methyltetradecylamino-4-methyl-5-nitrobenzoic acid

A mixture of 21.9 grams 2-methyltetradecylamino-4-methyl-5-nitrobenzamide, 60.0 ml water, and 90.0 ml concentrated HCl was heated with stirring at reflux temperature for 16 hours, and then cooled, filtered, washed with water and vacuum dried. The crude product was digested with hot petroleum ether (b.p. = 70-100°), which was cooled and filtered, and the filter cake dried in air overnight. The product was recrystallized from a 3:1 ethanol-water mixture and then recrystallized again from petroleum ether (b.p. 90-100°). Yield = 13.3 grams. m.p. = 98-100°.

| | Analysis | |
|---|---|---|
| | Calc. | Found |
| C | 68.12 | 68.36; 68.29 |
| H | 9.20 | 9.43; 9.46 |
| N | 6.91 | 6.88; 6.80 |

d. Preparation of 5-amino-4-methyl-2-N-methyltetradecylaminobenzoic acid.

13.3 grams of 2-methyltetradecylamino-4-methyl-5-nitrobenzoic acid was reduced in 100 ml ethanol with 5% palladium on carbon catalyst under 50 pounds original pressure in a Parr pressure hydrogenator. After the reduction was complete, the catalyst was filtered off and the ethanol was stripped off under reduced pressure. The product was dried in a vacuum. Yield = 11.4 grams. m.p. = 98–104°.

| | Analysis | |
|---|---|---|
| | Calc. | Found |
| C | 73.40 | 73.25; 73.10 |
| H | 10.63 | 10.89; 10.69 |
| N | 7.45 | 6.98; 6.91 |

EXAMPLE V

Following the procedure in Example 1 of U.S. Pat. No. 3,301,772, a dispersion was prepared from the components below:

| | parts by weight |
|---|---|
| Cyan color former* | 10 |
| Developer of Example I, II, III or IV | 10 |
| 1-phenoxy-2-propanol (oil) | 30 |
| Sodium alkyl naphthalene sulfonate (10%) - surfactant | 50 |
| Aqueous gelatin (4%) | 250 |

*Cyan color former:

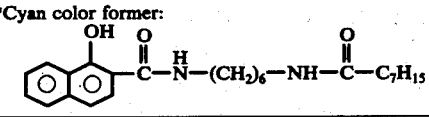

Each dispersion was mixed with a photosensitive silver bromoiodide emulsion (9% silver, 7.5% gelatin) containing the usual coating adjuvants, such as coating aids, stabilizer, etc., and the mixture was in the weight ratio of dispersion to emulsion of 1:1, coated by means of a Cascade coater onto a polyester base to form a photographic element. After exposure, the strips of each element were treated with a processing solution containing 0.5 g/l of Phenidone B at a pH of 12.7. It was determined by dipping white-lighted strips into the above processing solution that complete development occurred from ¼ to ½ minute at 75° F. At one minute development, a D-min of 0.42 and a D-max of 1.64 was read (red light) for the developer of Example IV, and five-day oven tests showed a maximum of 0.04 gain in D-min.

A sample of the film strip using 3-carboxy-4-(N-methyl-N-tetradecylamino)aniline as the developer was allowed to stand in the laboratory for over one year without noticeable environmental degradation of the developer. Conventional paraphenylenediamine developers decompose in one week under the same conditions.

EXAMPLE VI

The following dispersion was made according to the procedure used in Example 1 of U.S. Pat. No. 3,301,772:

| | |
|---|---|
| Cyan color former of Example V | 8 g |
| Tricresylphosphate (oil) | 12 g |
| N-butylacetanilide (oil) | 12 g |
| 2-methyl-4-(N-methyl-N-tetradecyl)amino-5-carboxyaniline | 12 g |
| Gelatin | 12 g |
| $H_2O$ | 124 cc |
| Sodium alkyl naphthalene sulfonate (10% solution) | 20 cc |

The dispersion was mixed 50:50 by weight with a red sensitized 9% silver by weight silver halide emulsion (1.5% I, 98.5% Br, 7.5% gelatin) containing the usual adjuvants, such as hardener and coating aids, and was cascade coated to a thickness of 3.0μ on a polyester base.

The resulting film was exposed by red light to a step wedge and married to a receiving sheet having a coating of hardened gelatin on a $TiO_2$-containing film base, with a simultaneous application of the following processing solution having a pH of 13.5:

| Solution A | | |
|---|---|---|
| $H_2O$ | 400.0 | ml |
| $Na_2SO_3$ | 1.5 | g |
| KBr | 5.0 | g |
| 45% KOH | 20.0 | ml |
| hydroxylamine sulfate | 1.5 | g |
| 1% carboxy methyl cellulose | 50.0 | ml |
| Phenidone B | 0.5 | g |

After a contact time of 30 seconds in the processing solution, the receiving sheet was removed and was then dipped into a 4% solution of 2-methyl-4-(N,N-dimethylamino)aniline and further treated with a 2% sodium persulfate solution. A cyan positive image of the step wedge was recorded on the receiving sheet.

EXAMPLE VII

The procedure of Example VI was followed except that the cyan color former was replaced with:

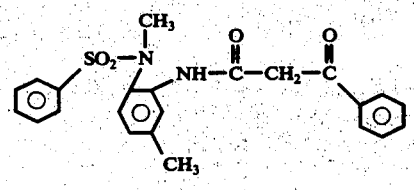

(yellow color former)

and the oils (tri-cresyl phosphate and N-butylacetanilide) were replaced with 1-phenoxy-2-propanol. No spectral sensitizer was added. The negative was exposed by white light to a step wedge and then treated as in Example VI. A positive yellow image was recorded on the receiving sheet.

EXAMPLE VIII

The procedure of Example VI was followed except that the cyan color former was replaced with:

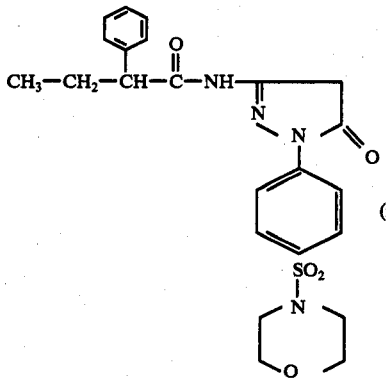

(magenta color former)

and the silver halide emulsion was green-sensitized. A magenta positive image was recorded on the receiving sheet.

EXAMPLE IX

Following the procedures of Examples VI and VII, a multilayer element was prepared by coating on a support a 3.5μ layer of the dispersion/red sensitized silver halide admixture of Example VI, a 1.0μ separation layer of yellow colloidal silver in gelatin and 3.0μ layer of the dispersion/unsensitized silver halide admixture of Example VII.

The element was exposed to patches of blue and red light and processed as in Example VI. A green image with cyan and yellow patches corresponding to the blue and red light exposures respectively was recorded on the receiving sheet.

EXAMPLE X

Example IX was repeated but without the incorporated developer 6-methyl-4-(N-methyl-N-tetradecyl-)amino-3-carboxyaniline in either of the silver halide layers. The film unit was exposed imagewise as in Example IX and processed in the following processing solution having a pH of 13.0:

| Solution B | | |
|---|---|---|
| $H_2O$ | 800 | ml |
| $Na_2SO_3$ | 2.0 | g |
| KBr | 5.0 | g |
| KOH | 20 | cc |
| 2-methyl-4(N,N-dimethylamino)aniline | 4.0 | g |
| Hydroxylamine sulfate | 1.5 | g |
| 1% carboxymethyl cellulose | 50 | cc |

The receiving sheet was then treated with 2% persulfate and yielded a white and yellow image corresponding to blue and red light exposures, respectively. The white image indicated that "cross-talk" or "dye-drop off" takes place when the incorporated developers were omitted and the color developers of the known art were used in the processing solution.

EXAMPLE XI

Following the procedure of Example VI, a series of dispersions were prepared using 12cc of 1-phenoxy-2-propanol as the oil and using 4 grams each of colored couplers A through F in place of the cyan color former. These dispersions were mixed with the silver iodobromide emulsion of Example VI, but either unsensitized or appropriately sensitized for the given coupler, and the mixtures coated as in Example VI on polyester bases.

The films thus prepared were exposed to light of appropriate color and married to a receiving sheet containing stearyl benzyl dimethyl ammonium chloride:-gelatins 50:50 by weight, coated to a thickness of 10μ on resin coated paper stock with simultaneous application of solution A of Example VI. After 1 minute of contact with Solution A, colored positive images were recorded on the receiving sheet.

EXAMPLE XII

Following the procedures of Example XI, a film unit was constructed having the following layers, in order, on a support:

1. a 3.5μ layer of the green-sensitized silver iodobromide emulsion of Example VI containing colored coupler E and the developer of Example IV;
2. a 1.0μ separation layer of yellow colloidal silver in gelatin;
3. a 3.0μ layer of an unsensitized silver iodobromide emulsion of Example VI containing colored coupler B and the developer of Example VI.

Layers 1 and 3 were coated from the mixture of dispersion/emulsion as in Example XI.

The unit was exposed imagewise to blue and green light and processed as in Example XI. After 5 minutes contact with Solution A, a red background with yellow and magenta positive images corresponding to green and blue recordings, respectively, was obtained on the quaternary amine-containing receiving sheet. No magenta dye "fall-off" which would denote dye drop-off or cross-talk was noted.

EXAMPLE XIII

The unit described in Example XII was processed as in Example XII but married instead to a receiving sheet of the following construction:

On a clear polyester base a receiving layer of styrylbenzyl-dimethyl ammonium chloride:gel, 50:50 by weight coated to a thickness of 10μ. This was overcoated with a 1% $TiO_2$ dispersion of 4% gel to a thickness of 5.0μ. The receiving sheet material was hardened with formaldehyde.

After a contact time of 5 minutes in Solution A, an image consisting of a red background with yellow and magenta positive images could be seen by viewing through the backside (through the base) of the receiving sheet. Of the dye transferred, more than 95% of the dye passed through the $TiO_2$ layer.

Figure 2:
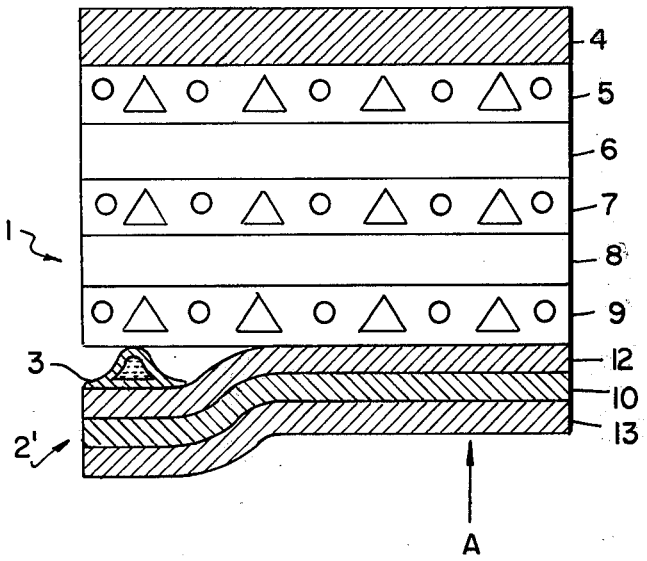

FIGS. 1 and 2 illustrate film units useful in carrying out the present invention.

FIG. 1 shows a film unit 1, receiving sheet 2 and rupturable pod 3. The film unit 1 is exposed to actinic radiation in the direction shown by arrow A and, after exposure, the film unit 1 is married to receiving sheet 2 and the film unit 1, pod 3 and receiving sheet 2 are passed through compression rollers (not shown) in a conventional manner to rupture the contents of the pod 3. Pod 3 contains an alkaline processing solution comprising the auxiliary developer, such as Solution A of Example VI.

The film unit 1 has a support 4, such as a polyester film base, on which is coated the following layers:

5 — red-sensitive silver halide emulsion containing a coupler and a developer of the invention dispersed in an oily material;

6 — gelatin separation layer;

7 — green-sensitive silver halide emulsion containing a coupler and a developer of the invention dispersed in an oily material;

8 — gelatin sparation layer containing colloidal yellow silver;

9 — blue-sensitive silver halide emulsion containing a coupler and a developer of the invention dispersed in an oily material;

10 — image receiving layer

11 — white opaque film or paper base

The silver halide grains 20 and the oily material 21 containing the developer and coupler are shown schematically in layers 5, 7 and 9. Where the coupler in layers 5, 7 and 9 is a colored coupler, the image-receiving layer is a dyeable material as described above and needs no further treatment to obtain a positive image; the receiving sheet 2 is simply peeled from the film unit 1 and the image is veiwed by looking at layer 10.

Where the coupler in layers 5, 7 and 9 is a colorless color former, the receiving sheet 2 is peeled from film unit 1 and treated with an alkaline solution containing a color developer and an oxidizing agent. In this case, layer 10 still contains a mordant for the dye image. Viewing is as described above.

FIGS. 2 illustrates a non-peel apart system. Exposure and development are as in FIG. 1, except that the receiving sheet 2' is left in contact with the film unit 1. As in the case of FIG. 1, where colorless couplers are employed, the alkaline processing solution is used after the film unit is treated with the contents of the pod 2.

Receiving sheet 2' comprises the following layers:

12 — a dispersion of $TiO_2$ in gelatin;

10 — image receiving layer;

13 — transparent film base.

Other film packages may be employed including, without limitation, those described in Cole U.S. Pat. No. 3,635,707.

In the description and Examples above, gelatin was used as a hydrophilic colloidal matrix. It is understood, however, that gelatin substitutes, such as polyvinyl alcohol, methyl cellulose, casein and other hydrophilic colloids, may also be employed.

What we claim is:

1. A photographic element, comprising a supported, light-sensitive silver halide emulsion having incorporated therein, or in a layer adjacent thereto, the compound of the general formula:

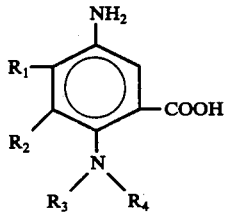

where $R_1$ is hydrogen, halogen, an aliphatic group or an aromatic group;

$R_2$ is hydrogen; and $R_3$ and $R_4$ are independently hydrogen, an aliphatic group or an aromatic group; or $R_2$ and $R_3$ together represent the necessary ring members to form a heterocyclic ring with the nitrogen atom to which $R_3$ is attached being the sole heteroatom or there being a second heteroatom selected from nitrogen, oxygen and sulfur; or $R_3$ and $R_4$ together represent the necessary ring members to form a heterocyclic ring with the nitrogen atom to which they are attached being the sole heteroatom or there being a second heteroatom selected from nitogren, oxygen and sulfur; provided that at least one of $R_1$, $R_2$, $R_3$ and $R_4$ by itself, or the net effect of $R_1$, $R_2$, $R_3$ and $R_4$ is of such molecular size and essentially non-diffusible during development in an alkaline processing composition as a developer, wherein said developer is dissolved or dispersed in a high boiling, photographically inert oil.

2. The photographic element according to claim 1, wherein said developer is incorporated into said emulsion.

3. The photographic element according to claim 1, wherein said developer is incorporated into a layer adjacent said emulsion.

4. The photographic element according to claim 1, wherein said oil dispersion also comprises a lipophilic reactant that is reactive with the oxidized form of said developer to form a coupled product that is non-diffusible at a predetermined pH.

5. The photographic element according to claim 4, wherein said reactant is a lipophilic coupler that is soluble in said oil, essentially non-diffusing through the photographic element at pH below the development pH but is diffusible at the development pH, and is reactive with oxidized developer to form a coupled product that is non-diffusible at the development pH.

6. The photographic element according to claim 5, wherein said lipophilic coupler is a colored coupler.

7. The photographic element according to claim 5, wherein said lipophilic coupler is a colorless color former.

8. The photographic element according to claim 4, wherein said reactant is a lipophilic coupler that is soluble in said oil, essentially non-diffusing through the photographic element, and is reactive with oxidized developer to form a coupled product that is non-diffusible at the development pH.

9. A multi-color diffusion transfer photographic element, comprising a. a photographic support;

b. a plurality of silver halide emulsion layers on said support, each emulsion layer being sensitized to light of a different color;

c. a dispersion in a high boiling photographically inert oil of a compound of claim 1 as a color developer, said oil dispersion being incorporated into said emulsion layers or layers adjacent thereto;

d. a lipophilic coupler in said oil dispersion, said coupler being non-diffusible through the photographic element at pH below the development pH but diffusible at the development pH, said coupler being reactive to form a coupled product upon coupling with the oxidation product of said color developer that is non-diffusible at the development pH, and said coupler being a colored coupler of a hue complementary to the color to which its associated silver halide emulsion layer is sensitive or being a color former reactive to form a dye having said complementary color upon coupling with oxidized color developer; and e. an image receiving means for immobilizing dye images transferred to or formed in said means.

10. The photographic element according to claim 9, wherein said coupler is a colored coupler and said image receiving means includes a mordant.

11. The photographic element according to claim 9, wherein said coupler is a color former and said image receiving means includes a mordant having means therein for oxidizing color developer.

12. A process of producing a photographic image in the photographic element of claim 1, which comprises developing the photographic element of claim 1, after image-wise exposure thereof to actinic radiation, in an alkaline medium containing a black and white photographic developer exhibiting an activating effect with the developer incorporated into the photographic element.

13. A process of producing a photographic image in the photographic element of claim 5, which comprises developing the photographic element of claim 5, after image-wise exposure thereof to actinic radiation, in an alkaline medium containing a black and white photographic developer exhibiting an activating effect with the developer incorporated into the photographic element.

14. A process of producing a photographic image in the photographic element of claim 9, which comprises developing the photographic element of claim 9, after image-wise exposure thereof to actinic radiation, in an alkaline medium containing a black and white photographic developer exhibiting an activating effect with the developer incorporated into the photographic element and allowing coupler that has not reacted with said incorporated developer to diffuse to the image receiving means.

15. The process according to claim 14, wherein said coupler is a colorless color former, and the color former transferred to said image receiving sheet is converted to a dye in the presence of oxidized color developer.

16. The process according to claim 12, wherein the black and whitephotographic developer is Metol, phenidone A or phenidone B.

17. The process according to claim 13, wherein the black and whitephotographic developer is Metol, phenidone A or phenidone B.

18. The process according to claim 14, wherein the black and whit ephotographic developer is Metol, phenidone A or phenidone B.

19. The process according to claim 15, wherein the black and white photographic developer is Metol, phenidone A or phenidone B.

* * * * *